US009909358B2

(12) United States Patent
Ungs et al.

(10) Patent No.: US 9,909,358 B2
(45) Date of Patent: Mar. 6, 2018

(54) FLEXIBLE INSULATED DOOR PANELS WITH INTERNAL BAFFLES

(75) Inventors: Mark Ungs, Dubuque, IA (US); Glenn R. Manich, Mequon, WI (US)

(73) Assignee: RITE-HITE HOLDING CORPORATION, Milwaukee, WI (US)

( * ) Notice: Subject to any disclaimer, the term of this patent is extended or adjusted under 35 U.S.C. 154(b) by 824 days.

(21) Appl. No.: 12/843,538

(22) Filed: Jul. 26, 2010

(65) Prior Publication Data

US 2012/0018102 A1 Jan. 26, 2012

(51) Int. Cl.
*E06B 9/13* (2006.01)
*E06B 9/17* (2006.01)

(52) U.S. Cl.
CPC ..... *E06B 9/13* (2013.01); *E06B 2009/17069* (2013.01)

(58) Field of Classification Search
CPC ..... E06B 9/13; E06B 2009/17069
USPC ... 160/201, 232, 236, 230, 231.1, 231.2, 41, 160/133, 330; 52/2.17, 2.22, 2.23, 2.24; 428/117; 5/728
See application file for complete search history.

(56) References Cited

U.S. PATENT DOCUMENTS 1,421,906 A * 7/1922 Calef ..... 5/502
2,113,068 A * 4/1938 McLaughlin, Jr. ..... 428/74
2,342,839 A * 2/1944 Byers ..... 428/126
3,017,218 A 1/1962 Groth et al.
3,036,670 A 5/1962 Jewell
3,055,379 A 9/1962 Fink
3,186,896 A * 6/1965 Clem ..... 428/182
3,231,006 A * 1/1966 Fisher et al. ..... 160/41
3,544,417 A * 12/1970 Corzine ..... 428/104
3,662,410 A 5/1972 Lankheet
3,724,526 A 4/1973 Huprich
(Continued)

FOREIGN PATENT DOCUMENTS

CN 2692316 4/2005
DE 2722005 11/1977
(Continued)

OTHER PUBLICATIONS

United States Patent and Trademark Office, "Non-Final Office Action," issued in connection with U.S. Appl. No. 12/325,944, dated Nov. 2, 2010, 11 pages.
(Continued)

*Primary Examiner* — Blair M Johnson
(74) *Attorney, Agent, or Firm* — Hanley, Flight & Zimmerman, LLC

(57) ABSTRACT

An example of a vertically operating door includes a flexible panel comprising two pliable sheets of material with a plurality of pads or mats of thermal insulation between the two sheets. In some examples, a plurality of horizontally elongate baffles made of pliable strips of material are installed between the two sheets. The baffles effectively divide one large interior volume between the sheets into more manageable smaller volumes or chambers. The baffles restrict the air between the sheets from being forced to the bottom of the panel as the panel ascends and bends across an overhead roller. Without the baffles and smaller chambers, the panel sheets in the area near the bottom of the panel would tend to bulge outward as the door opens.

17 Claims, 13 Drawing Sheets

(56) References Cited

U.S. PATENT DOCUMENTS

| | | | | | |
|---|---|---|---|---|---|
| 3,856,072 | A | * | 12/1974 | Sund | 160/84.01 |
| 3,975,882 | A | * | 8/1976 | Walter | 52/571 |
| 4,040,210 | A | | 7/1977 | Land | |
| 4,039,019 | A | * | 8/1977 | Hopper | 160/121.1 |
| 4,070,839 | A | * | 1/1978 | Clem | 52/448 |
| 4,115,610 | A | * | 9/1978 | Wortman | 428/102 |
| 4,255,907 | A | | 3/1981 | Lightell | |
| 4,294,875 | A | * | 10/1981 | Schramm | 428/72 |
| 4,506,720 | A | * | 3/1985 | Iwanicki | 160/26 |
| 5,016,700 | A | | 5/1991 | Wegner et al. | |
| 5,249,323 | A | * | 10/1993 | Kikuchi et al. | 5/502 |
| 5,544,690 | A | | 8/1996 | Magro et al. | |
| 5,586,594 | A | * | 12/1996 | Shapoff | 160/135 |
| 5,664,613 | A | * | 9/1997 | Jelic | 160/84.05 |
| 5,738,161 | A | | 4/1998 | Martin | |
| 5,813,172 | A | * | 9/1998 | McNally | 52/2.25 |
| 5,855,235 | A | * | 1/1999 | Colson et al. | 160/121.1 |
| 5,915,445 | A | | 6/1999 | Rauenbusch | |
| 6,001,199 | A | * | 12/1999 | Colson et al. | 156/65 |
| 6,112,797 | A | * | 9/2000 | Colson et al. | 160/121.1 |
| 6,119,758 | A | | 9/2000 | Coenraets | |
| 6,199,337 | B1 | * | 3/2001 | Colson et al. | 52/506.06 |
| 6,354,353 | B1 | | 3/2002 | Green et al. | |
| 6,659,158 | B2 | | 12/2003 | Laugenbach | |
| 6,688,369 | B2 | * | 2/2004 | Colson et al. | 160/121.1 |
| 6,725,898 | B2 | | 4/2004 | Mullet et al. | |
| 7,059,378 | B2 | * | 6/2006 | Colson et al. | 160/121.1 |
| 7,748,169 | B2 | * | 7/2010 | Cote | 52/2.11 |
| 7,992,678 | B2 | * | 8/2011 | Pilaar | 181/284 |
| 8,043,690 | B2 | * | 10/2011 | Hand et al. | 428/182 |
| 2001/0005964 | A1 | * | 7/2001 | Colson et al. | 52/506.06 |
| 2003/0041981 | A1 | | 3/2003 | Cramer, III | |
| 2007/0277943 | A1 | | 12/2007 | Boerger et al. | |
| 2008/0110580 | A1 | | 5/2008 | Hoerner et al. | |
| 2009/0139665 | A1 | * | 6/2009 | Cha | 160/87 |
| 2010/0132894 | A1 | * | 6/2010 | Knutson et al. | 160/113 |
| 2011/0289857 | A1 | * | 12/2011 | Pilaar | 52/2.22 |
| 2012/0018102 | A1 | * | 1/2012 | Ungs et al. | 160/113 |
| 2012/0085504 | A1 | * | 4/2012 | Cha | 160/236 |
| 2013/0098567 | A1 | * | 4/2013 | Ashelin et al. | 160/330 |

FOREIGN PATENT DOCUMENTS

| | | | |
|---|---|---|---|
| EP | 0123508 | A2 | 10/1984 |
| EP | 0358920 | | 3/1990 |
| JP | 3093791 | | 10/2000 |
| NL | 7805464 | | 10/1979 |
| RU | 1778263 | | 11/1992 |
| RU | 2571814 | | 12/2015 |
| WO | 9112404 | | 8/1991 |
| WO | 2011065933 | | 6/2011 |

OTHER PUBLICATIONS

International Searching Authority, "Search Report," issued in connection with International Patent Application Serial No. PCT/US09/65554, dated Mar. 29, 2012, 5 pages.

International Searching Authority, "Written Opinion," issued in connection with International Patent Application Serial No. PCT/US09/65554, dated Mar. 29, 2012, 7 pages.

United States Patent and Trademark Office, "Final Office Action," issued in connection with U.S. Appl. No. 12/325,944, dated May 18, 2012, 8 pages.

International Searching Authority, "International Preliminary Report on Patentability," issued in connection with International Patent Application Serial No. PCT/US09/65554, dated Apr. 19, 2012, 9 pages.

United States Patent and Trademark Office, "Final Office Action," issued in connection with U.S. Appl. No. 12/325,944, dated Jul. 22, 2011, 6 pages.

International Searching Authority, "International Search Report" issued in connection with International application No. PCT/US2011/042947, dated Sep. 28, 2011, 3 pages.

International Searching Authority, "Written Opinion of the International Searching Authority" issued in connection with application No. PCT/US2011/042947, dated Sep. 28, 2011, 5 pages.

IP Australia, "Examination Report," issued in connection with Australian Patent Application No. 2009355386, dated Oct. 16, 2012 (3 pages).

New Zealand Patent Office, "First Examination Report," issued in connection with New Zealand Patent Application No. 593206, dated Aug. 16, 2012, 4 pages.

United States Patent and Trademark Office, "Non-Final Office Action," issued in connection with U.S. Appl. No. 12/325,944, dated Sep. 7, 2012, 8 pages.

Advisory Action issued by the United States Patent and Trademark Office dated Aug. 2, 2012 in connection with U.S. Appl. No. 12/325,944 (3 pages).

First Official Action issued by the Canadian Intellectual Property Office dated May 22, 2012, in connection with Canadian Patent Application No. 2,745,244 (3 pages).

United States Patent and Trademark Office, "Examiner's Answer," issued in connection with U.S. Appl. No. 12/325,944, dated Oct. 10, 2013, 11 pages.

Mexico Patent Office, "Office Action," issued in connection with Mexican Application No. MX/a/2011/005757, dated Oct. 4, 2013, and corresponding English translation, 7 pages.

New Zealand Intellectual Property Office, "First Examination Report," issued in connection with New Zealand Application No. 605738, dated Aug. 19, 2013, 2 pages.

European Patent Office, "Examination Report," issued in connection with European Application No. 11731231.4, dated Nov. 8, 2013, 5 pages.

The United States Patent and Trademark Office, "Non-Final Office action", issued in connection with U.S. Appl. No. 12/325,944, dated Nov. 3, 2011, 9 pages.

The United States Patent and Trademark Office, "Advisory action", issued in connection with U.S. Appl. No. 12/325,944, dated Oct. 7, 2011, 3 pages.

Australian Intellectual Property Office, "Certificate of Grant", issued in connection with Australia patent No. 2009355386, dated Jan. 30, 2014, 1 page.

State Intellectual Property Office of the People's Republic of China "First Office action", issued in connection with Chinese patent application No. 200980150894.X, dated Dec. 23, 2013, 5 pages.

Mexican Intellectual Property Office, "Office action", issued in connection with Patent application No. MX/a/2011/005757, dated Feb. 13, 2014, 5 pages.

New Zealand Intellectual Property Office, "Letters Patent", issued in connection with New Zealand patent No. 593206, dated Mar. 4, 2014, 1 page.

Australian Intellectual Property Office, "Patent Examination Report No. 1", issued in connection with Australia patent No. 2011283144, dated Apr. 14, 2014, 4 pages.

Japanese Patent Office, "Notice of Reasons for Rejection" issued in connection with corresponding Japanese Patent Application No. P2013-521792 dated Mar. 4, 2014 (4 pages).

State Intellectual Property Office of the People's Republic of China, "Second Office Action", in connection with Chinese patent application No. 200980150894.X, dated May 20, 2014,13 pages.

Russian Intellectual Property Office, "Office action", issued in connection with Russian patent application No. 2013103440, dated May 28, 2014, 8 pages.

State Intellectual Property Office of the People's Republic of China, "First Office action", issued in connection with Chinese patent application No. 201180036502.4, dated Jun. 11, 2014, 7 pages.

Canadian Intellectual Property Office, "Letters of Patent", issued in connection with Canadian patent application No. 2,745,244, dated Jul. 15, 2014, 1 page.

Japanese Patent Office, "Notice of Allowance", issued in connection with Japanese Patent application No. 2013-521792, dated Sep. 24, 2014. (English Translation not provided), 4 pages.

Mexican Patent Office, "Office action", issued in connection with mexican patent application No. MX/a/2011/005757, dated Sep. 8, 2014, 5 pages.

(56) References Cited

OTHER PUBLICATIONS

Mexican Patent Office, "Office action", issued in connection with Mexican patent application No. MX/a/2013/000678, dated May 28, 2015, 3 Pages.
Australian Intellectual Property Office, "Notice of Acceptance", issued in connection with Australian patent application No. 2011283144, dated Jun. 3, 2014, 1 page.
European Patent Office, "Decision to grant a European patent pursuant to Article 97(1)EPC", issued in connection with European patent application No. 11731231.4, dated Jul. 23, 2015, 2 pages.
Chinese Intellectual Property Office, "Notice of Completing Formalities for Patent Registration", issued in connection with Chinese patent application No. 200980150894.X, dated Sep. 23, 2015, 4 pages.
Australian Patent Office, "Certificate of Grant", issued in connection with Australian patent No. 2011283144, dated Oct. 1, 2015, 1 page.
European Patent Office, "Intend to Grant", issued in connection with European patent application No. 11 731 231.4-1604, dated Feb. 11, 2015, 35 pages.
Chinese Patent Office, "The Third Office action", issued in connection with Chinese patent application No. 200980150894.X, dated Apr. 10, 2015, 4 pages.
Chinese Patent Office, "Decision to revoke decision", issued in connection with Chinese patent office action No. 200980150894.X, dated Apr. 2, 2015, 2 pages. ( English translation not provided).
Mexican Patent Office, "Office Action", issued in connection with Mexican patent office action No. MX/a/2011/005757, dated Mar. 19, 2015, 6 pages.
Intellectual Property Office of New Zealand, "Letters Patent", issued in connection with New Zealand patent No. 605738, dated May 1, 2015, 1 page.
Russian Patent Office, "Substantive Examination", issued in connection with Russian patent application No. 2013103440, dated Nov. 21, 2014, 9 pages.
New Zealand Intellectual Property Office, "Notice of Acceptance", issued in connection with New Zealand patent application No. 605738, dated Jan. 28, 2015, 1 page.
European Patent Office, "Communication under Rule 71(3) EPC", issued in connection with European patent application No. 11 731 231.4, dated Feb. 11, 2015, 35 pages.
Chinese Patent Office, "Notice of Completing formalities for Patent Registration", issued in connection with Chinese patent application No. 201180036502.4, dated Mar. 5, 2015, 8 pages.
New Zealand Intellectual Property Office, "Further Examination Report", issued in connection with New Zealand patent application No. 605738, dated Nov. 21, 2014, 2 pages.
Chinese Intellectual Property Office, "Decision of Rejection", issued in connection with Chinese patent application No. 200980150894.X, dated Nov. 15, 2014, 13 pages.
Canadian Intellectual Property Office, "Notice of Allowance", issued in connection with canadian patent application No. 2,806,022, dated Nov. 27, 2014, 1 page.
Japanese Patent Office, "Certificate of Patent", issued in connection with Japanese patent application No. 2013-521792, dated Oct. 31, 2014, 2 pages.
Mexican Patent Office, "Notice of Allowance", issued in connection with Mexican patent application No. MX/a/2013/000678, dated Sep. 28, 2015, 2 pages.
United States Patent and Trademark Office, "Notice of Allowance," issued in connection with U.S. Appl. No. 12/325,944, dated Jun. 14, 2016, 25 pages.
European Patent Office, "Communication pursuant to Article 94(3) EPC", issued in connection with European patent application No. 09 851 353.4, dated May 6, 2016, 6 pages.
Mexican Industrial Property Institute, "Notice of Allowance," issued in connection with Mexican Patent Application No. MX/a/2011/005757, dated Jan. 20, 2017, 2 pages.
United States Patent and Trademark Office, "Decision on Appeal", issued in connection with U.S. Appl. No. 12/325,944, dated Apr. 20, 2016, 10 pages.
European Patent Office, "Communication pursuant to Rules 161(1) and 162 EPC," issued in connection with European Application No. 09851353.4, dated May 25, 2012, 2 pages.
State Intellectual Property Office of China, "First Office Action," issued in connection with corresponding Chinese Patent Application No. 200980150894.X, dated Dec. 23, 2013, and corresponding English translation, 11 pages.
Canadian Intellectual Property Office, "Notice of Allowance," issued in connection with Canadian Application No. 2,745,244, dated Jan. 2, 2014, 1 page.
Canadian Intellectual Property Office, "Office Action," issued in connection with Canadian Application No. 2,806,022, dated Jan. 6, 2014, 2 pages.
Intellectual Property Office of New Zealand, "Notice of Acceptance," issued in connection with New Zealand Patent Application No. 593,206, dated Nov. 13, 2013, 1 page.
Intellectual Property Office of Australia, "Notice of Acceptance," issued in connection with corresponding Australian Patent Application No. 2009355386, dated Oct. 4, 2013, 2 pages.
PCT, "International Preliminary Report on Patentability," issued in connection with International Patent Application No. PCT/US2011/042947, dated Feb. 7, 2013 (6 pages).
USPTO, "Final Office Action," issued in connection with U.S. Appl. No. 12/325,944, dated Feb. 21, 2013 (15 pages).
CIPO, "Office Action," issued in connection with Canadian Patent Application No. 2,745,244, dated Mar. 14, 2013 (2 pages).

* cited by examiner

FLEXIBLE INSULATED DOOR PANELS WITH INTERNAL BAFFLES

FIELD OF THE DISCLOSURE

This patent generally relates to insulated doors and, more specifically, to doors that include a flexible panel such as an insulated curtain.

BACKGROUND

Cold storage rooms are refrigerated areas in a building that are commonly used for storing perishable foods. Cold storage rooms are typically large enough for forklifts and other material handling equipment to enter. Access to the room is often through a power actuated insulated door that separates the room from the rest of the building. To minimize thermal losses when someone enters or leaves the room, the door preferably opens and closes as quickly as possible.

Vertically operating roll-up doors and similar doors with flexible curtains are perhaps some of the fastest operating doors available. When such a door opens, its curtain usually bends upon traveling from its closed position in front of the doorway to its open position on an overhead storage track or take-up roller.

Such bending is not a problem if the curtain is relatively thin. However, an insulated curtain may not bend as well due to the required thickness of the insulation. When a take-up roller or curved track bends a thick curtain, relative translation may occur between opposite faces of the curtain. Designing a thick, insulated curtain that can accommodate such translation can be challenging.

Moreover, if an insulated curtain becomes temporarily creased or locally compressed along the horizontal line where the curtain bends, such a crease or compression might trap a pocket of air inside the curtain, and that trapped air might cause the curtain to bulge and adversely affect the door's operation.

DETAILED DESCRIPTION

Figure 1:
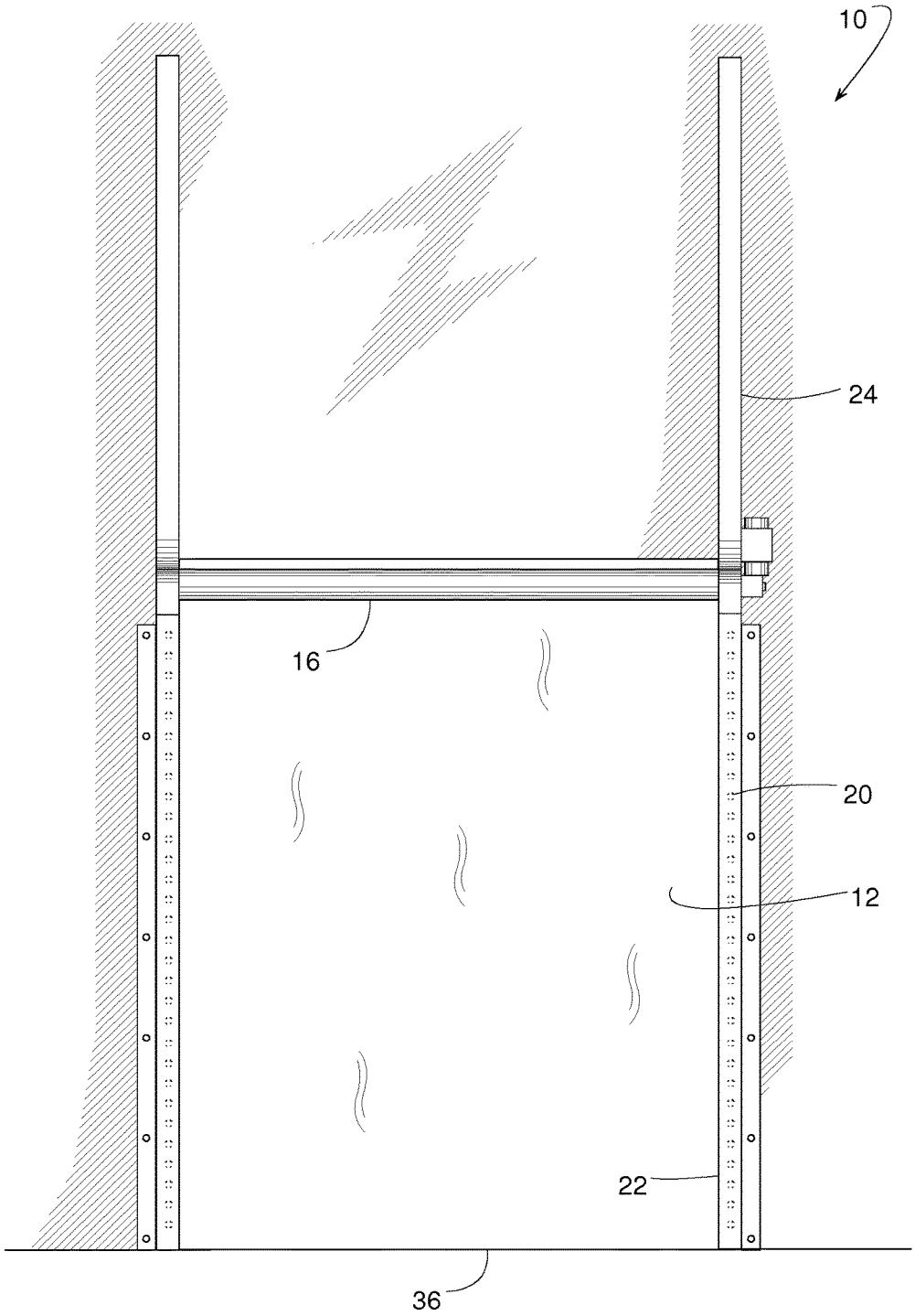
FIG. 1 is a front view showing an example door in a closed position.
Figure 2:
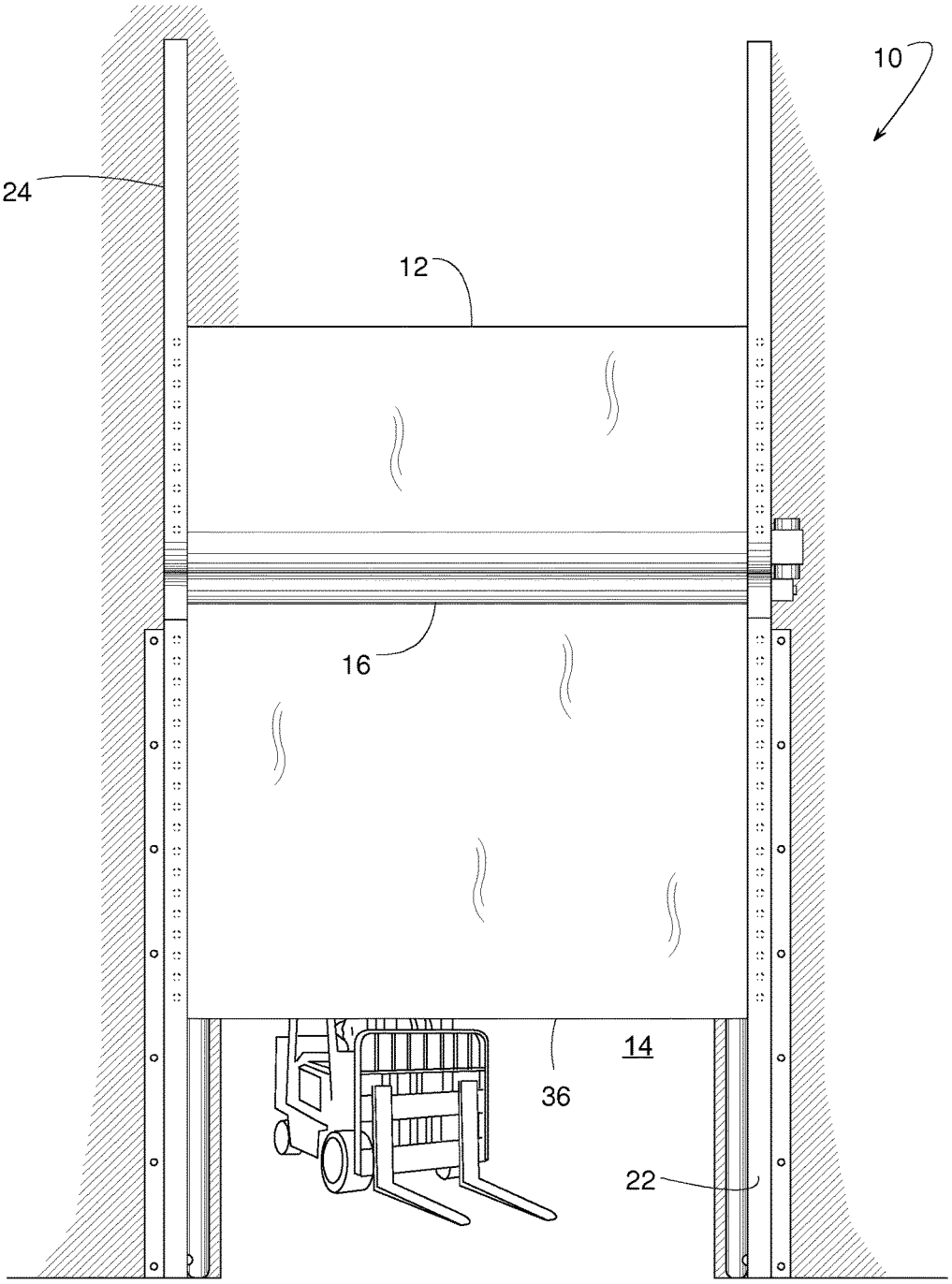
FIG. 2 is a front view similar to FIG. 1 but showing the example door partially open.
Figure 3:
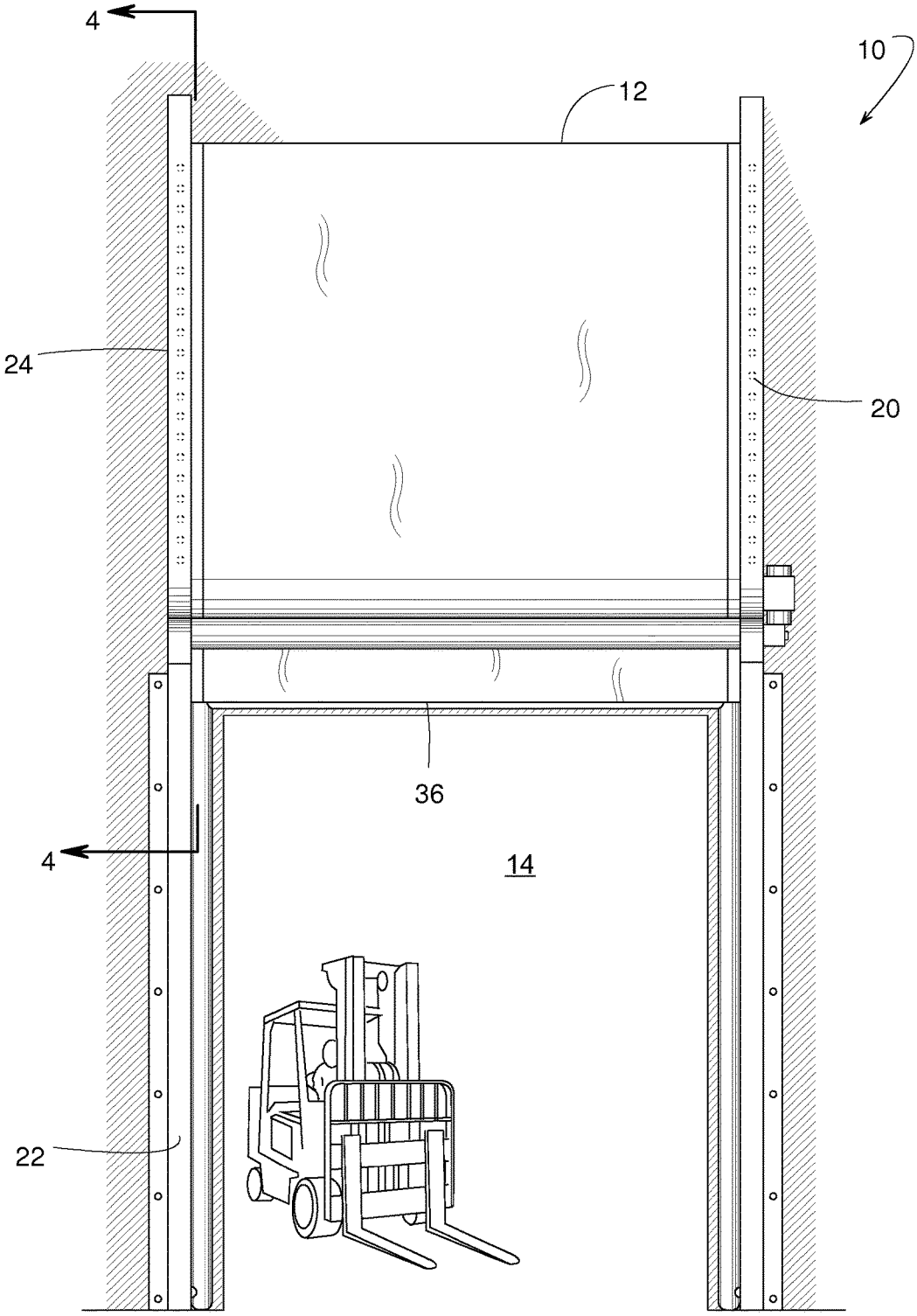
FIG. 3 is a front view similar to FIGS. 1 and 2 but showing the example door in an open position.
Figure 4:
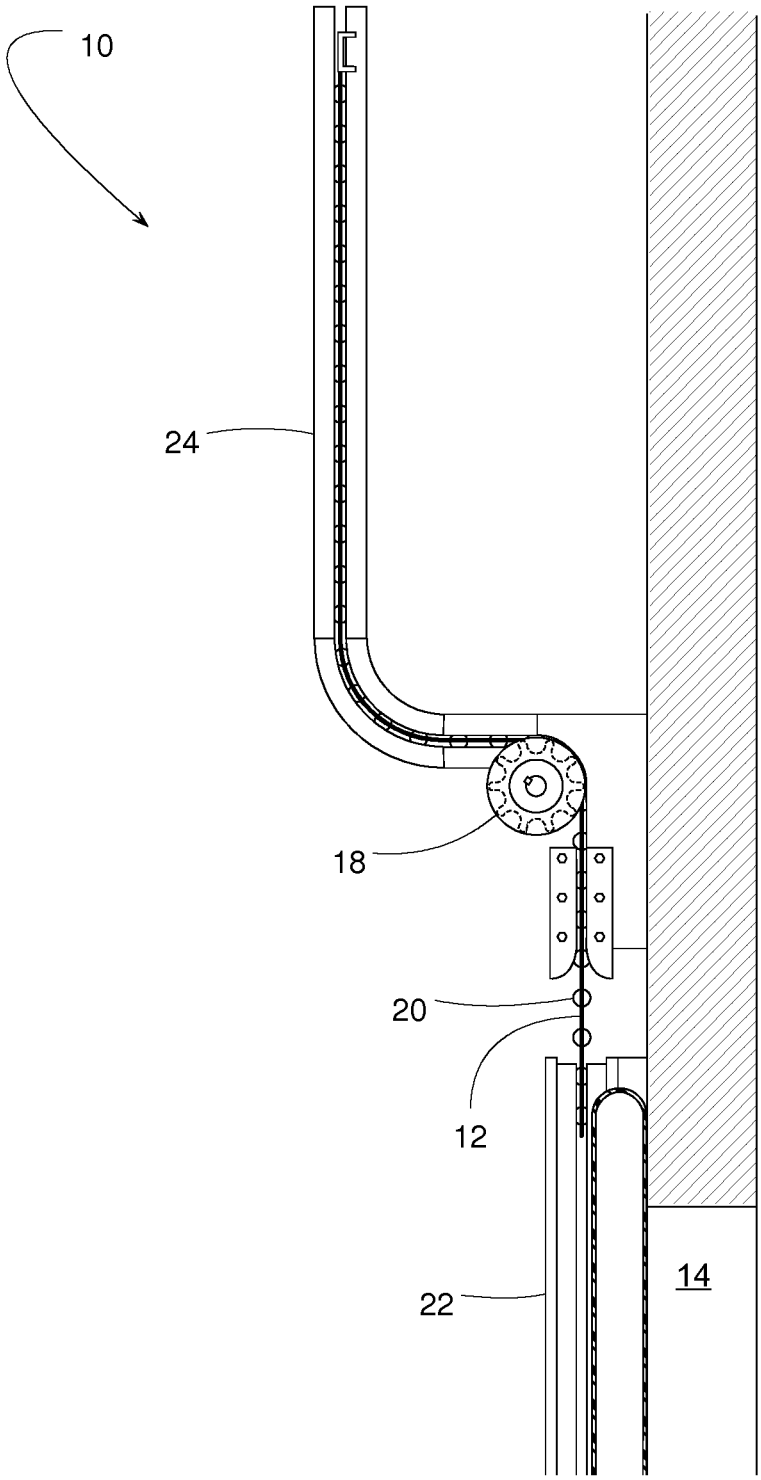
FIG. 4 is a cross-sectional view taken along line 4-4 of FIG. 3.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

FIGS. 1-4 illustrate a vertically operating door 10 that includes a flexible, insulated door panel 12 with means for managing undesirable air pressure conditions inside the panel. Door 10 is shown closed in FIG. 1, partially open in FIG. 2, and fully open in FIGS. 3 and 4. As door 10 opens and closes relative to a doorway 14, door panel 12 bends over a mandrel 16, which contributes to the air pressure problem that is addressed by the example methods and apparatus described herein. Mandrel 16 can be a fixed bar or a roller that extends across the width of doorway 14. Although door panel 12 is shown having a certain double-bend, stored configuration, other stored configurations, such as coiled, wound on a roll tube, single-bend horizontal, serpentine, vertically planar, etc., are all well within the scope of this disclosure. Door 10 is particularly suited for a cold storage room. However, door 10 could also be applied to any other desired application.

With the exception of door panel 12 itself, the structure, operation and other details of door 10 are described and illustrated in U.S. Patent Application Publication No. US 2008/0110580 A1, which is hereby incorporated herein by reference in its entirety. Generally, a powered drive sprocket 18 (FIG. 4) engages a cogged strip 20 at each lateral edge of door panel 12 to move door panel 12 between a lower guide track 22, where door panel 12 is blocking doorway 14, and an upper track 24 where door panel 12 is clear of the doorway. It should be noted, however, that door panel 12 can be applied to various other types of doors that operate with different drive or storage configurations. In each case, the thickness of the door panel, combined with air trapped therein and a bending of the panel, can cause the trapped air to balloon the bottom of the curtain or panel as the door opens.

Publication No. US 2008/0110580 A1 also explains the benefit of equipping an insulated door panel with an evacuation blower. However, unlike that published application, the example apparatus described herein enables the door panel 12 to be advantageously utilized without such a blower and associated hardware.

Figure 5:
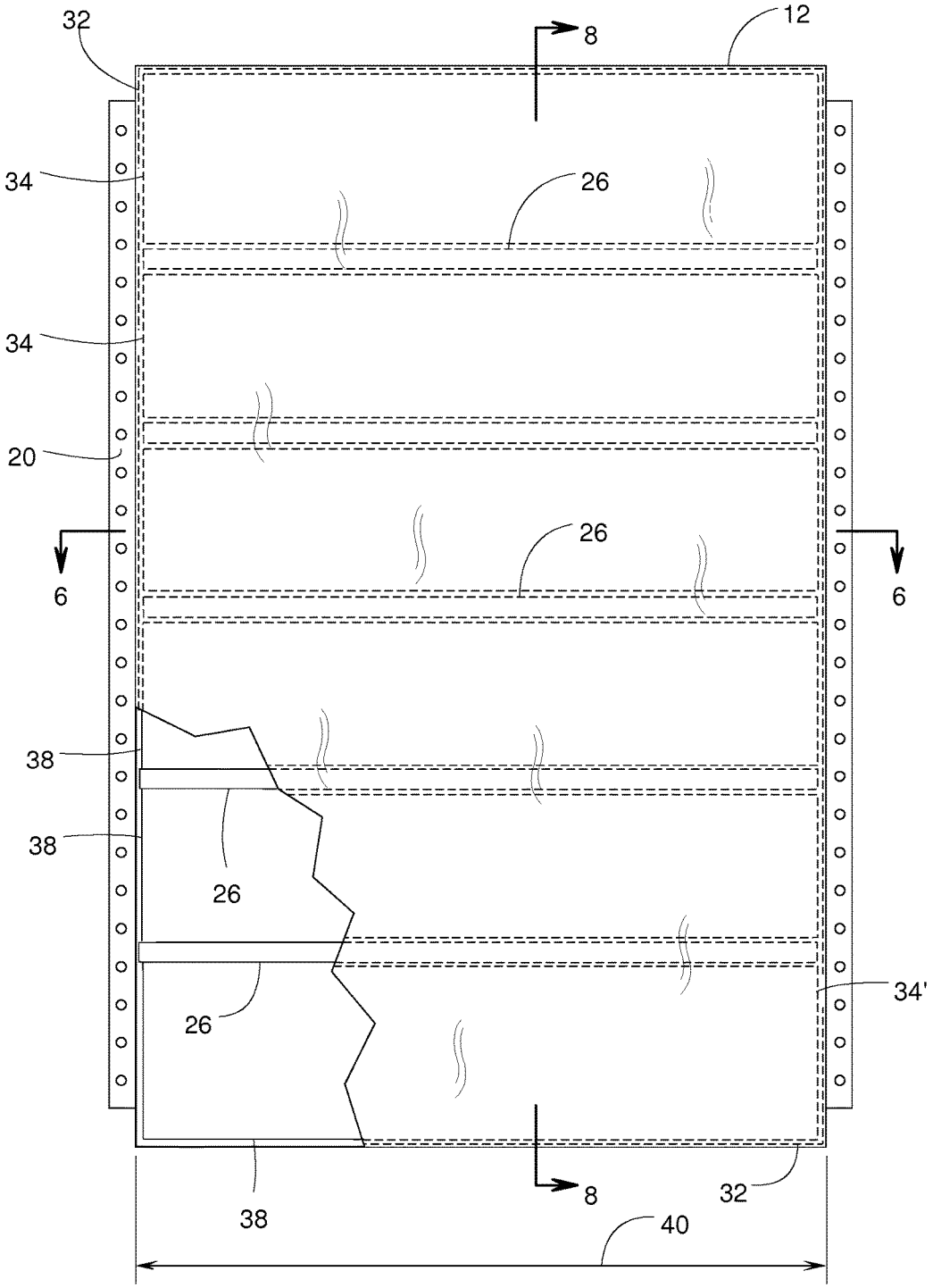
FIG. 5 is a front view of the example door panel of FIGS. 1-3 with a lower-left section of the panel's outer sheet cutaway.
Figure 6:
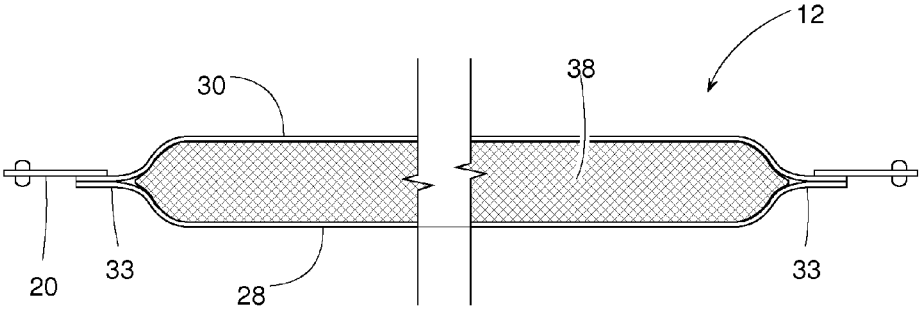
FIG. 6 is a cross-sectional view taken along line 6-6 of FIG. 5.
Figure 7:
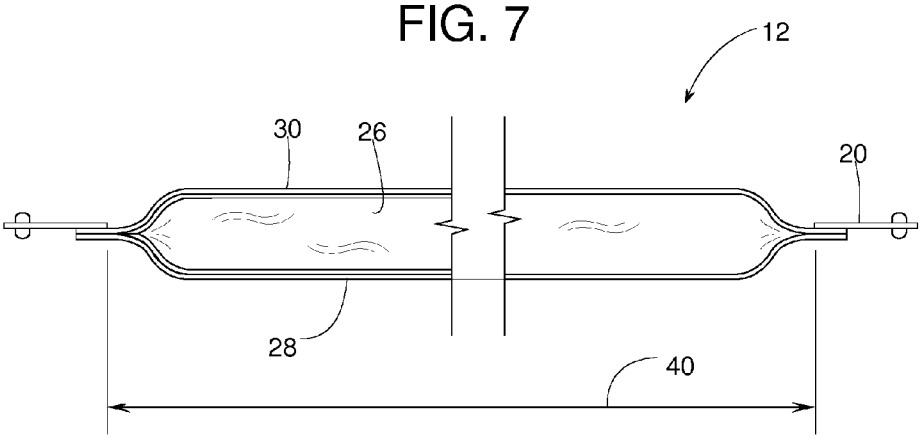
FIG. 7 is a cross-sectional view similar to FIG. 6 but with the insulation omitted to more clearly show one of the example baffles.
Figure 8:
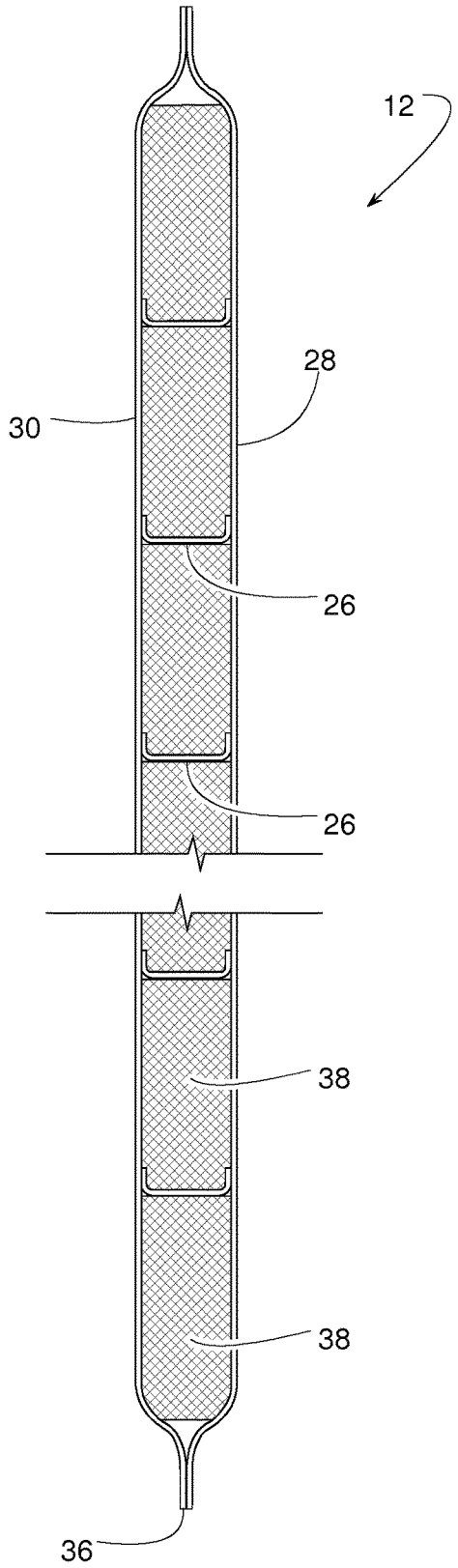
FIG. 8 is a cross-sectional view taken along line 8-8 of FIG. 5.

Instead of using an evacuation blower, door panel 12 includes a plurality of pliable baffles 26 that restrict the redistribution of air contained between a first sheet 28 and a second sheet 30 of door panel 12. Sheets 28 and 30 are joined and generally sealed along their outer perimeter to create one large overall air chamber 32 between sheets 28 and 30. Baffles 26 divide chamber 32 into a plurality of more manageable smaller chambers 34. For illustrative clarity, baffles 26 and chambers 32 and 34 are shown in FIG. 5 to extend slightly less than a full width 40 of door panel 12, however, baffles 26 and chambers 32 and 34 preferably extend the full width of door panel 12 as depicted in FIG. 5. As door 10 opens and creates a horizontal crease in sheets 28 and 30 (e.g., where door panel 12 bends over mandrel 16), baffles 26 help reduce and/or prevent air trapped within chamber 32 from over inflating the lower end of door panel 12. Thus, baffles 26 limit or even prevent the area between mandrel 16 and a lower leading edge 36 of door panel 12 from bulging excessively as door 10 opens.

While the division of large chamber 32 into smaller, more manageable chambers 34 helps solve the problems caused by air trapped in door panel 12, baffles 26 used for this purpose may have other desirable properties. For example, baffles 26 may be sufficiently flexible to accommodate some relative translation between sheets 28 and 30 as door panel 12 bends over mandrel 16. The flexibility of baffles 26 may also enable door panel 12 to restorably break away if something were to accidentally collide with the door. Additionally or alternatively, baffles 26 may be sufficiently flexible to conformingly mate with the lateral edges or vertical seams 33 of sheets 28 and 30 so that there is minimal leakage or air exchange between chambers 34. Further, in some examples, baffles 26 preferably are sufficiently stiff to maintain a desired spacing between sheets 28 and 30, particularly in examples where insulation is not used for maintaining such spacing. Further yet, in some examples, baffles 26 preferably have a thermal conductivity that generally is less than or equal to that of sheets 28 and 30. The R-value of air enhanced with insulation in chambers 34 may be sufficient for reducing or even preventing frost from forming on door panel 12. However, if baffles 26 have relatively high thermal conductivity, frost lines might form on sheet 28 or 30 where baffles 26 connect to those sheets.

Although the actual construction of door panel 12 may vary, the illustrated examples have sheets 28 and 30 being made of any suitable polymeric or natural fabric material that is preferably pliable and can be joined along their outer perimeter by adhesion, tape, melting/fusing/welding, sewing, hook-and-loop fastener, snaps, rivets, zipper, etc. Substantially the entire outer perimeter, including seams 33 and the upper and lower edges of door panel 12, is preferably sealed to reduce or even prevent appreciable amounts of air from flowing in and out of chamber 32. Inhibiting moist air from repeatedly entering chamber 32 reduces or even prevents mold-promoting moisture from condensing inside chamber 32 on a panel sheet that is facing, for example, a cold storage room.

Baffles 26 can be made of a material similar to or different than that of sheets 28 and 30. The flexibility of sheets 28 and 30 enables door panel 12 to bend over mandrel 16, while the flexibility of baffles 26 enables limited relative translation between sheets 28 and 30 as door 10 opens and closes. As door 10 opens or closes and door panel 12 travels and bends across mandrel 16, this action urges relative vertical translation between sheets 28 and 30. Thermal insulation or thermal insulation pad(s) 38, such as porous foam pads or polyester mats, preferably is installed within chambers 34.

For the illustrated examples, baffles 26 are horizontally elongate, which enable them to not only restrict vertical airflow within door panel 12 but also to accommodate relative vertical translation between sheets 28 and 30. In other examples, door panel 12 is provided with vertically elongate baffles or a combination of vertical and horizontal baffles.

To effectively restrict airflow within door panel 12, horizontally elongate baffles 26 preferably extend along at least most of the full width 40 of door panel 12. To facilitate manufacturing, however, baffles 26 can be made slightly shorter than the panel's full width 40 to make it easier to join the lateral vertical edges of sheets 28 and 30 together. Baffles 26 being a little shorter than full width 40 of door panel 12 places the plurality of air chambers 34 in fluid communication with each other. Thus, as door 10 opens and door panel 12 travels across mandrel 16, some air within door panel 12 will be temporarily redistributed to at least one of the lower chambers (e.g., air chamber 34') of the plurality of chambers 34, thereby slightly increasing the air pressure within chamber 34' temporarily, but not really detrimentally.

Figure 9:
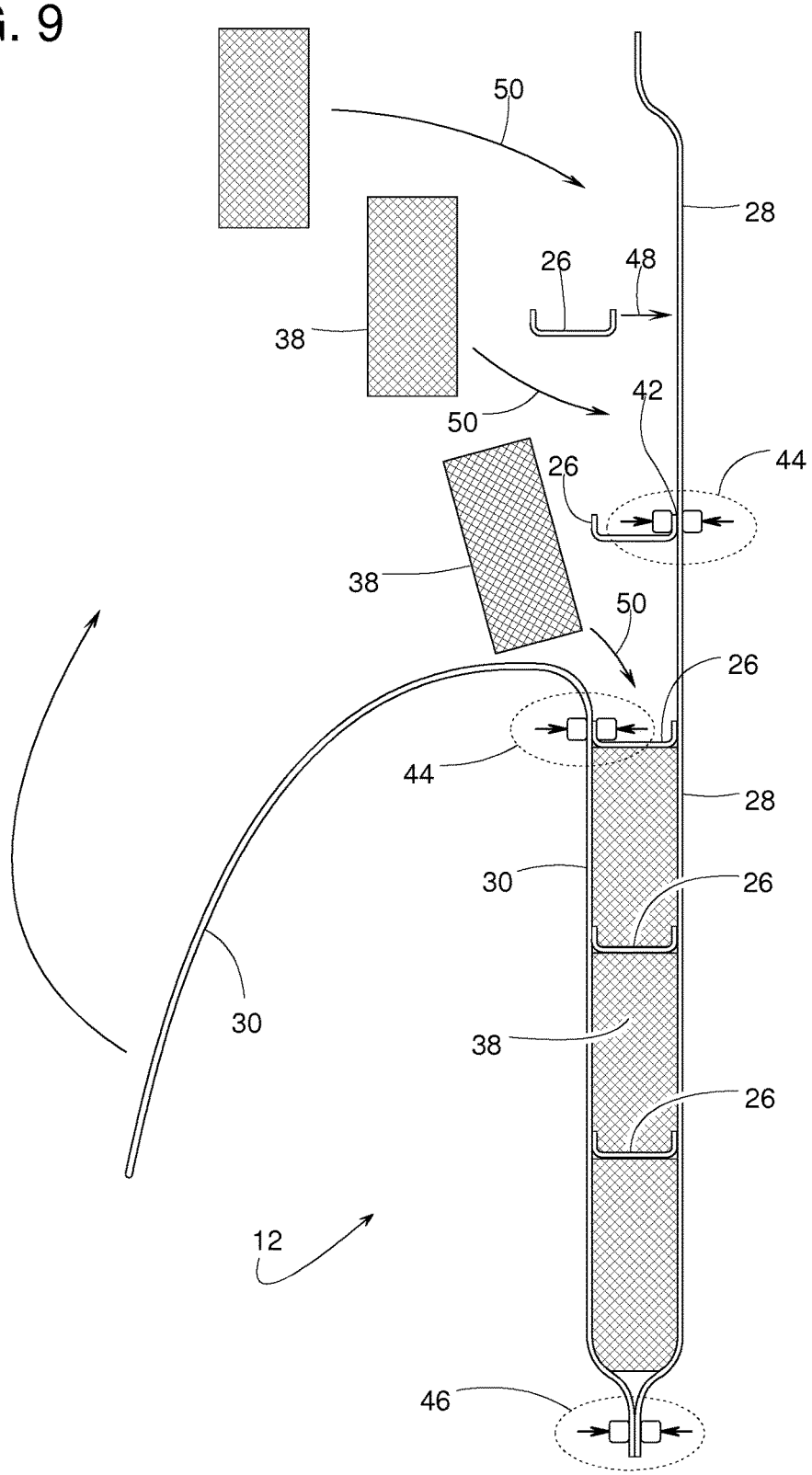
FIG. 9 is a cross-sectional view similar to FIG. 8 but showing the example door panel being assembled.

Although door panel 12 could be manufactured by several different methods, FIG. 9 illustrates one example manufacturing method. One horizontal edge of each baffle 26 is melted or ultrasonically welded to first sheet 28, thereby creating a plurality of fused joints 42 between sheet 28 and each of baffles 26. Fusing baffles 26 to at least one of sheets 28 and 30 is schematically depicted by the block at reference number 44 of FIG. 9. Alternate methods of attaching baffles 26 in place include, but are not limited to, bonding, taping, sewing, fastening via hook-and-loop fastener, riveting, etc.

An outer perimeter of sheet 28 is fused, sewn or otherwise connected to sheet 30 as schematically depicted by the block at reference number 46 of FIG. 9. The plurality of baffles 26 are installed between sheets 28 and 30, as schematically depicted by arrow 48 and insulation 38 is installed within chambers 34, as schematically depicted by arrows 50. The example method represented by the block at reference number 44 and arrows 48 and 50 may be done generally together in a progressive sequence from one end of door panel 12 to another or in any other suitable order. FIG. 9, for example, shows door panel 12 being assembled progressively from the bottom up.

As noted above, a requirement for a door providing access to a cold storage room is that the door reduces and preferably minimizes thermal loss, thereby also reducing or preventing the formation of condensation on the door. This requirement can be met by providing a door that opens and closes very quickly to reduce and preferably minimize thermal loss when a person enters or exits the cold storage room and a door that is well-insulated to reduce or even prevent thermal loss (and condensation formation) when the door is closed. However, these solutions (a fast operating door and a well-insulated door) typically have characteristics that work against each other. For example, flexible, vertically-operating doors, or curtains, are some of the fastest operating doors available, but these doors, or curtains, typically must bend or curve (e.g., about a mandrel) as the door moves between its closed and opened positions. A well-insulated door is typically filled with thick, heavy insulation having a high R-value, but this type of insulation is difficult to move quickly, does not bend well, and may allow for air pockets to become trapped inside the curtain, or door. It is therefore desirable to provide a fast moving, flexible, vertically-operating door that provides an R-value sufficient to reduce or even prevent condensation from forming on the door, while still being able to bend and move without trapping significant amounts of air within the curtain, or door.

Figure 10:
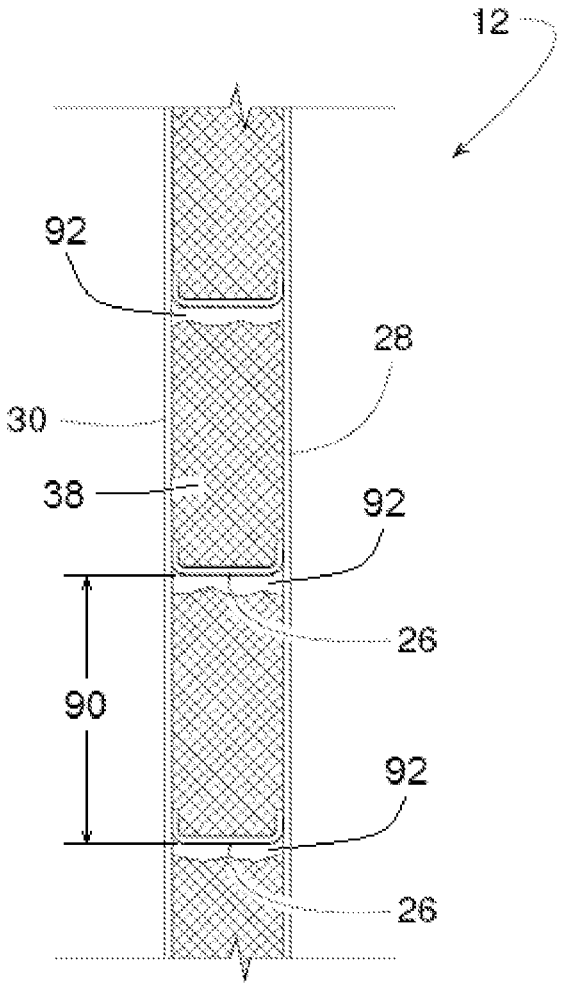
FIG. 10 is a cross-sectional view similar to FIG. 8.

While using baffles 26 to divide a large chamber 32 into smaller, more manageable chambers 34 helps solve the problems caused by air trapped in a large door panel 12, utilizing smaller insulation pads 38 inside of these smaller, more manageable chambers 34 has its own challenges. For example, over time, thermal insulation pads 38 may begin to sag, or slouch, due to the effects of gravity and/or the repeated bending and flexing associated with the door opening and closing. When an insulation pad 38 sags, or slouches, as shown in FIG. 10, the insulation pad no longer spans the space defined between the baffles 26 (nominal baffle spacing 90), resulting in an air gap 92, or air pocket 92, forming in chamber 34 above the insulation pad 38. The term nominal baffle spacing refers to the distance between the center of area, or geometric center, of a first baffle to the center of area, or geometric center, of a second, adjacent baffle. The nominal baffle spacing may not be equal throughout the door panel. Air gaps, or pockets 92, are problematic because they provide a region of reduced R-value in the door, thereby allowing for the increased thermal loss that often results in condensation (e.g., frost) forming on sheet 28 or 30, a phenomenon that may be particularly bad where air gap, or pocket 92, provides a continuous (uninterrupted) path between sheets 28 and 30. It would therefore, be desirable to reduce or even eliminate air gaps 92 that may develop between adjacent insulation pads 38, thereby helping to maintain throughout the door, an R-value sufficient to reduce or even prevent condensation from forming on sheets 28 or 30.

A method for reducing or even preventing an air gap, or pocket, from forming between adjacent insulation pads 38 may include packing, or jamming, oversized insulation pads 38 into chamber 34, wherein the insulation pads 38 are oversized by being taller than the nominal baffle spacing. While this method may be effective at reducing or even preventing air gaps from forming, it may be difficult to pack, or jam, a large, wide insulation pad 38 into a smaller chamber 34, and the forces exerted by the compressed insulation pad may make it difficult to assemble the door as shown in FIG. 9.

Figure 11:
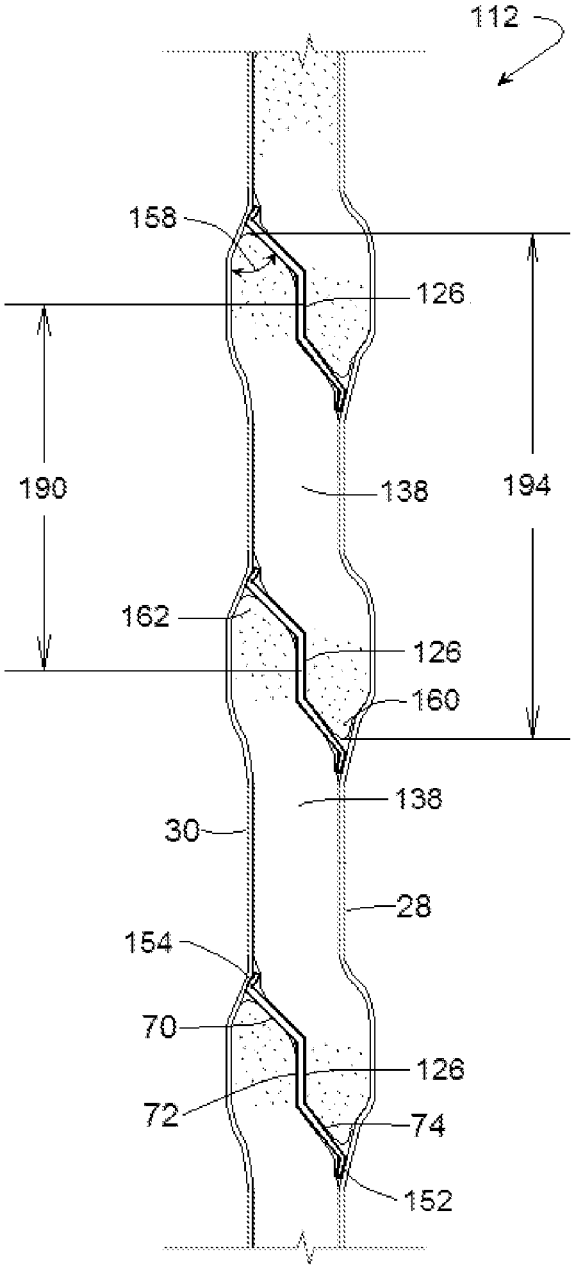
FIG. 11 is a cross-sectional view similar to FIG. 8 but showing another example door panel.

An example of incorporating insulation pads 38 into chambers 34 is shown in FIG. 11, where door panel 112 (similar to panel 12) includes baffles 126 with a unique cross-sectional shape that enables adjacent insulation pads 138' to overlap each other to provide an R-value sufficient to reduce or even prevent condensation from forming on sheets 28 or 30. In this example, each baffle 126 comprises a first edge 152 joined and/or coupled to sheet 28, a second edge 154 joined and/or coupled to sheet 30, and a first central portion 70, a second central portion 72, and a third central portion 74, wherein the central portions extend between edges 152 and 154, and the first central portion 70 and third central portion 74 are non-perpendicular and nonparallel to sheets 28 and 30. First central portion 70 and third central portion 74 may be substantially parallel to each other, while lying at angle 158 to sheet 30. In some examples, angle 158 is approximately 45 degrees. Second central portion 72 may be substantially parallel to sheets 28 and 30. The specific angular relationship between central portions 10, 72, 74 and sheets 28 and 30 is not critical, as long as at least one of central portions 70 or 74 is not perpendicular to sheets 28 and 30.

Adjacent baffles 126 define a nominal baffle spacing 190 that is smaller than an effective height 194 of the insulation pads 138, such that insulation pads 138 are packed into sheets 28 and 30 with insulation pads 138 overlapping each other, thereby reducing or even preventing the formation of air gaps, or pockets, and effectively reducing heat transfer through panel 112. The term nominal baffle spacing refers to the distance between the center of area, or geometric center, of a first baffle to the center of area, or geometric center, of a second, adjacent baffle. The nominal baffle spacing 90' may not be equal throughout the door panel. The effective height 194 of insulation pad 138 is the distance between the uppermost point of the insulation pad and the lowermost point of the insulation pad. FIG. 11, for example, shows a lowermost edge, or portion, 160 of a first pad 138 being lower than an uppermost edge, or portion, 162 of a second pad 138, wherein the first pad 138 is higher than and/or longitudinally spaced-apart from the second pad 38. Insulation pads 138 may be constructed of porous foam pads, polyester mats, or other flexible materials with a relatively high R-value. In some examples, the insulation pads 138 may have an R-value of between about 2 and 8. In some examples, the insulation pads 138 may have an R-value of approximately 4. The cross-sectional shape of baffles 126 and the overlapping configuration of adjacent insulation pads 138 reduce or even prevent low R-value air gaps, or pockets, from forming, thereby reducing heat transfer through the door panel and reducing or even preventing the formation of condensation on sheets 28 or 30, but the example door panel 112 of FIG. 11 may include bulges in the regions where adjacent insulation panels overlap, wherein those bulges may be undesirable in certain applications.

Figure 12:
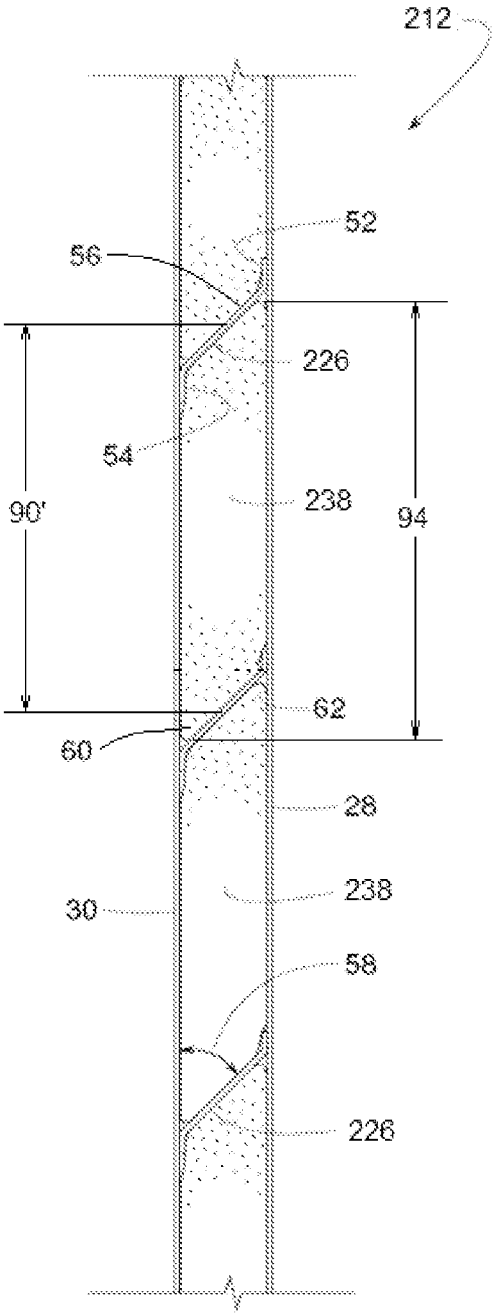
FIG. 12 is a cross-sectional view similar to FIG. 8 but showing another example door panel.

FIG. 12 shows an example door panel 212 that is similar to door panel 112, but represents an alternative to the example door panel 112 of FIG. 11. In order to help ensure a uniform R-value throughout the door panel 212 (even between adjacent insulation pads 238) while still allowing the door panel 212 to move and bend without unduly trapping air within the curtain, or door, door panel 212 includes an oversized insulation pad 238 with a cross-sectional geometry that enables adjacent insulation pads to effectively overlap, without the potentially undesirable bulge that exists in door panel 112 of FIG. 11. Insulation pad 238 is oversized in that it has an effective height 94 that exceeds the nominal baffle spacing 90'. The term nominal baffle spacing refers to the distance between the center of area, or geometric center, of a first baffle to the center of area, or geometric center, of a second, adjacent baffle. The nominal baffle spacing 90' may not be equal throughout the door panel. The effective height 94 of an insulation pad 238 is the distance between the uppermost point of the insulation pad and the lowermost point of the insulation pad. Door panel 212 also includes pads of insulation 238 and baffles 226 that are configured to reduce or even prevent the formation of air gaps and reduce heat transfer through door panel 212, particularly where baffles 226 connect to sheets 28 and 30. In this example, each baffle 226 comprises a first edge 52 joined and/or coupled to sheet 28, a second edge 54 joined and/or coupled to sheet 30, and a central portion 56 extending between edges 52 and 54. Central portion 56 lies at an angle 58 relative to sheets 28 and 30 such that central portion 56 is neither perpendicular nor parallel to sheets 28 and 30. In some examples, angle 58 is approximately 45-degrees. Door panel 212 is shown in its closed position (as in FIG. 1), but baffles 226 are sufficiently flexible to deflect or otherwise move relative to sheets 28 and 30 as door panel 212 moves between its open and closed positions.

Baffles 226 lying at an angle enables the pads of insulation 238 to be shaped such that adjacent pads of insulation 238 overlap each other, which helps reduce or even prevent the formation of air gaps and further reduces heat transfer through door panel 212 (thereby reducing or even preventing the formation of condensation on sheet 28 or 30). FIG. 12, for example, shows a lowermost edge, or portion, 60 of a first pad 238 being lower than a uppermost edge, or portion, 62 of a second pad 238, wherein the first pad 238 is higher than and/or spaced-apart from the second pad 238. Examples of insulation pads 238 include, but are not limited to, porous foam pads and polyester mats. Insulation pads 238 may be cut so that edges have substantially the same angle as angle 58. Alternatively, insulation pads 238 are sufficiently pliable to be packed into the overlapping condition of FIG. 12, angled baffle 226 enabling this to be done without causing significant bulging in the overlapping region.

Figure 13:
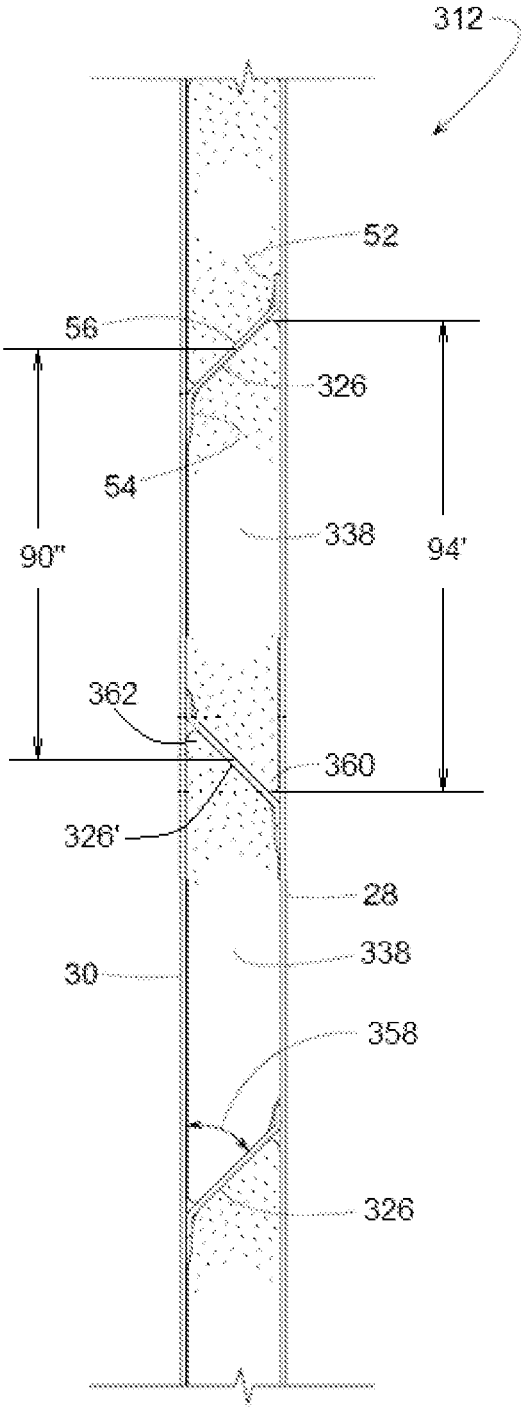
FIG. 13 is a cross-sectional view similar to FIG. 8 but showing another example door panel.

The exact non-perpendicular angular orientation of the baffles relative to the sheets 28 and 30 of the door is not critical, as long as the angle enables adjacent insulation pads to overlap to reduce heat transfer through the door panel and reduce and/or prevent the formation of condensation on sheet 28 or 30. FIG. 13 shows example door panel 312, which is similar to door panel 212, except that not all of the baffles have the same angular relationship to sheets 28 and 30, although angle 358 may be the same as or different from angle 258. As shown, baffle 326' is substantially perpendicular to baffles 326, an alternating pattern that could be repeated throughout the height of the door panel 312. Regardless of the specific angular relationships between the baffles 326 and 326' and the sheets 28 and 30, adjacent baffles 326 and 326' define a nominal baffle spacing 90" that is smaller than the effective height 94' of the insulation pads 338, ensuring that adjacent insulation pads overlap such that an uppermost portion 362 of a first insulation pad 338 is higher than and/or spaced apart-from a lowermost portion 360 of an adjacent insulation pad 338 that is disposed above the first insulation pad. The term nominal baffle spacing refers to the distance between the center of area, or geometric center, of a first baffle to the center of area, or geometric center, of a second, adjacent baffle. The nominal baffle spacing 90" may not be equal throughout the door panel. The effective height 94' of an insulation pad 238 is the distance between the uppermost point of the insulation pad and the lowermost point of the insulation pad. Taken together, baffles 326 and 326' disposed at a non-perpendicular angle relative to sheets 28 and 30 and overlapping adjacent insulation pads 338 reduce heat transfer through the door panel and reduce or even prevent the formation of condensation on sheet 28 or 30.

Figure 14:
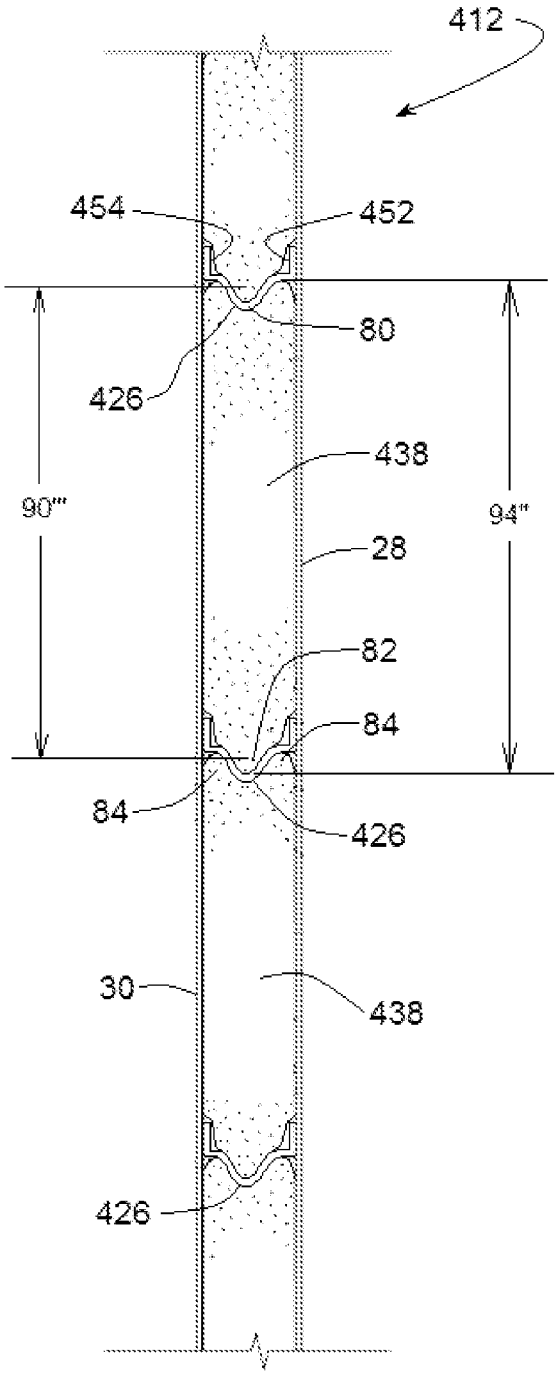
FIG. 14 is a cross-sectional view similar to FIG. 8 but showing another example door panel

FIG. 14 shows another example door panel 412 that provides effective insulation (an R-value sufficient to reduce or even prevent condensation on the exterior of the door panel) throughout the door panel (even in the region where two adjacent chambers meet) by utilizing adjacent insulation pads to bridge any air gaps, or pockets, that may otherwise exist between the insulation pads. FIG. 14 shows an example door panel 412 that is similar to door panel 312 but includes baffles 426 that enable adjacent insulation pads 438 to overlap each other in a manner that resembles a tongue and groove joint, wherein the overlapping insulation pads 438 help reduce heat transfer through door panel 412. In this example, each baffle 426 comprises a first edge 452 joined and/or coupled to sheet 28, a second edge 454 joined and/or coupled to sheet 30, and a central portion 80 extending between edges 452 and 454, wherein central portion 80 has a substantially U-shaped cross-section. The specific cross-sectional shape of baffle 426, though, is not critical. However, in some examples, the effective height 94" of the baffles 426 exceeds the nominal baffle spacing 90'. The term nominal baffle spacing refers to the distance between the center of area, or geometric center, of a first baffle to the center of area, or geometric center, of a second, adjacent baffle. The nominal baffle spacing 90' may not be equal throughout the door panel. The effective height 94 of an insulation pad 238 is the distance between the uppermost point of the insulation pad and the lowermost point of the insulation pad. This configuration helps ensure that baffles 426 or insulation pads 438 do not cause a region of reduced R-value in the door panel 412 to the point of forming condensation. As such, a V-shaped cross-section or a curvilinear cross-sectional shape may also be an effective cross-sectional shape.

The cross-sectional shape of baffles 426 enables the insulation pads 438 to be shaped such that pads of insulation 438 overlap each other, which further reduces heat transfer through door panel 412 and helps to ensure that no low R-value air gaps exist. FIG. 14, for example, shows an uppermost portion 84 of a first pad 438 being higher than and/or spaced-apart from a lowermost portion 82 of a second pad 438, wherein the first pad 438 is lower than the second pad 438. Insulation pads 438 may be constructed of porous foam pads, polyester mats, or other flexible materials with a relatively high R-value.

At least some of the aforementioned examples include one or more features and/or benefits including, but not limited to, the following:

In some examples, a door panel is comprised of two pliable sheets with a plurality of pliable baffles therebetween, wherein the baffles are horizontally elongate to not only restrict airflow within the panel but also to accommodate relative vertical translation between the two sheets.

In some examples, the baffles are sufficiently flexible or pliable to enable the two sheets to pinch together as the panel bends over a mandrel.

In some examples, a door panel is comprised of two pliable, generally parallel sheets to create an overall air chamber. The panel also includes a plurality of baffles that divide the overall air chamber into a plurality of smaller, more manageable chambers.

In some examples, the smaller, more manageable chambers are in fluid communication with each other.

In some examples, the horizontal baffles do not extend the full width of the door panel so that the perimeter of the panel's outer sheets can be readily joined to each other.

In some examples, the horizontal baffles extend as wide as possible to reduce or preferably minimize fluid communication between the smaller chambers.

In some examples, the air pressure within the lower chamber temporarily increases as the door opens.

In some examples, the internal baffles are fused rather than sewn to the outer sheets for ease of manufacturing and to reduce or preferably minimize air leakage between the interior and exterior of the door panel.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. A flexible door panel for moving between an open position and a closed position relative to a doorway, the door panel comprising:

a first unitarily formed sheet;

a second unitarily formed sheet that is generally parallel to the first sheet when the door panel is in the closed position;

a plurality of baffles extending between the first sheet and the second sheet to define a plurality of air chambers within the flexible door panel, wherein one of the plurality of baffles forms a first acute angle with the first sheet relative to a first side of the baffle and a second acute angle with the second sheet relative to a second side of the baffle when the flexible door panel is in the closed position;

a mandrel about which the door panel is to bend as the door moves between the open position and the closed position, the plurality of baffles to extend across the door panel parallel to the mandrel to restrict redistribution of air between the chambers as the panel is rolled about the mandrel; and separate insulation pads to be inserted in two adjacent chambers of the plurality of air chambers, the two adjacent chambers to be separated by the one of the plurality of baffles, wherein the insulation pads are to be unitarily formed with a self-held shape that is to substantially fill a first area defined by the first acute angle and a second area defined by the second acute angle, the plurality of baffles to be spaced apart such that the separate insulation pads are to abut the first and second sheets.

2. The flexible door panel of claim 1, wherein each baffle of the plurality of baffles comprises a first edge and a second edge with a central portion extending therebetween such that when the flexible door panel is in the closed position, the first and second edges are substantially parallel to each other, the first edge being joined flat against the first sheet, and the second edge being joined flat against the second sheet.

3. The flexible door panel of claim 2, wherein the first edge is higher than the second edge when the flexible door panel is in the closed position.

4. The flexible door panel of claim 1, wherein the first and second sheets are substantially sealed around a periphery of the door panel.

5. A door for a doorway, the door comprising:

a flexible door panel to move between an open position to allow passage through the doorway and a closed position to block passage through the doorway, the flexible door panel including a first sheet that is unitarily formed, a second sheet that is unitarily formed and is generally parallel to the first sheet when the door is in the closed position, and a plurality of individual baffles separately extending between the first sheet and the second sheet to define a plurality of chambers within the flexible door panel, a first of the plurality of baffles to separate first and second unitarily formed insulation pads disposed within chambers of the flexible door panel, the plurality of individual baffles to be spaced apart such that the first and second insulation pads are to abut the first and second sheets, the insulation pads having self-held shapes dimensioned to overlap within the flexible door panel when disposed in adjacent ones of the plurality of chambers; and a mandrel about which the door panel is to bend as the door moves between the open position and the closed position, the plurality of baffles to extend across the door panel parallel to the mandrel to restrict air from passing between the chambers as the panel is rolled about the mandrel, one or more of the plurality of baffles having a central portion that lies at an angle relative to the first sheet and the second sheet, the angle is other than 90-degrees when the flexible door panel is in the closed position.

6. The door of claim 5, wherein the angle remains substantially constant as the door moves between the open position and the closed position.

7. The door of claim 5, wherein each baffle of the plurality of baffles comprises a first edge and a second edge with the central portion extending therebetween such that when the flexible door panel is in the closed position, the first and second edges are substantially parallel to each other, the first edge is joined to the first sheet, and the second edge being joined to the second sheet.

8. The door of claim 7, wherein the first edge is longitudinally spaced-apart from the second edge when the flexible door panel is in the closed position.

9. The door of claim 5, wherein the first baffle is coupled to the first sheet at a first height when the door panel is in the closed position and coupled to the second sheet at a second height higher than the first height when the door panel is in the closed position, wherein the first insulation pad is above the first baffle and the second insulation pad is below the first baffle, the first insulation pad to extend below the second height and the second insulation pad to extend above the first height when the door panel is in the closed position.

10. The flexible door panel of claim 5, wherein a first edge of a first baffle of the plurality of baffles is connected to the first sheet at a first height, a second edge of the first baffle is connected to the second sheet at a second height greater than the first height, a first edge of a second baffle of the plurality of baffles is connected to the first sheet at a third height greater than the second height, and a second edge of the second baffle is connected to the second sheet at a fourth height greater than the second height.

11. The flexible door panel of claim 10, wherein the fourth height is greater than the third height.

12. The flexible door panel of claim 10, wherein the third height is greater than the fourth height.

13. A door for a doorway, the door comprising:

a flexible door panel movable between an open position and a closed position relative to the doorway, the flexible door panel including a first sheet that is unitarily formed, a second sheet that is unitarily formed and is generally parallel to the first sheet when the door is in the closed position, and a plurality of baffles extending between the first sheet and the second sheet to define a plurality of air chambers within the flexible door panel, the plurality of baffles to be spaced apart such that each of the plurality of air chambers are to be defined by both the first and second sheets;

a mandrel about which the door panel bends as the door opens and closes, the plurality of baffles to extend across the door panel parallel to the mandrel such that the plurality of air chambers are parallel to the mandrel and pass over the mandrel one at a time as the panel is rolled about the mandrel, the baffles to restrict air from passing between the chambers as the panel is rolled about the mandrel; and a first pad of insulation and a second pad of insulation interposed between the first sheet and the second sheet, the first pad of insulation being unitarily formed and in contact with both the first sheet and the second sheet, the second pad of insulation being unitarily formed and in contact with both the first sheet and the second sheet, one of the plurality of baffles being interposed between the first pad of insulation and the second pad of insulation, the first pad of insulation being higher than the second pad of insulation when the flexible door panel is in the closed position, the first pad of insulation and the second pad of insulation having self-held shapes that maintain an uppermost portion of the second pad of insulation higher than a lowermost portion of the first pad of insulation when the flexible door panel is in the closed position.

14. A flexible door panel movable between an open position and a closed position relative to a doorway, the door panel comprising:

a first sheet;

a second sheet that is generally parallel to the first sheet when the door is in the closed position, each of the first and second sheets unitarily formed;

a first baffle extending between the first sheet and the second sheet;

a second baffle extending between the first sheet and the second sheet and spaced apart from the first baffle to define a nominal baffle spacing between geometric centers of the first and second baffles;

a roller to wind and unwind the door panel as the door moves between the open position and the closed position, the first and second baffles to extend across the door panel parallel to the roller to restrict redistribution of air between chambers defined by the first and second baffles as the panel is wound about the roller; and a first unitarily formed insulation pad disposed between the first and second baffles, the first insulation pad having a self-held dimension in a direction extending between the first and second baffles that is greater than the nominal baffle spacing, the first insulation pad to abut the first sheet and the second sheet.

15. The flexible door panel of claim 14, wherein the first baffle includes a first edge and a second edge with a central portion extending therebetween such that when the flexible door panel is in the closed position, the first and second edges are substantially parallel to each other, the first edge being joined flat against the first sheet, and the second edge being joined flat against the second sheet.

16. The flexible door panel of claim 15, wherein the first edge is higher than the second edge when the flexible door panel is in the closed position.

17. The door of claim 14, further comprising a second insulation pad adjacent the first insulation pad, at least one of the first or second baffles separating the first and second insulation pads, the second insulation pad to partially overlap the first insulation pad in a direction defined by a plane of the door panel when the door panel is in the closed position.

* * * * *